US010021910B2

(12) United States Patent
Gavrielov et al.

(10) Patent No.: US 10,021,910 B2
(45) Date of Patent: Jul. 17, 2018

(54) E-VAPING SECTION AND E-VAPING DEVICE, AND A METHOD OF MANUFACTURING THEREOF

(71) Applicant: Altria Client Services LLC, Richmond, VA (US)

(72) Inventors: Shmuel Gavrielov, Jerusalem (IL); Moshe Eliyahu, Beit Shemesh (IL); Yechezkel Stern, Ramat Bet Shemesh (IL)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 152 days.

(21) Appl. No.: 14/940,781

(22) Filed: Nov. 13, 2015

(65) Prior Publication Data

US 2017/0135399 A1 May 18, 2017

(51) Int. Cl.

| | |
|---|---|
| ***A24F 13/00*** | (2006.01) |
| ***A24F 47/00*** | (2006.01) |
| ***H05B 3/00*** | (2006.01) |
| ***H05B 3/06*** | (2006.01) |

(52) U.S. Cl.
CPC ..... *A24F 47/008* (2013.01); *H05B 3/0014* (2013.01); *H05B 3/06* (2013.01)

(58) Field of Classification Search
CPC ..... A24F 47/008
USPC ..... 131/329
See application file for complete search history.

(56) References Cited

U.S. PATENT DOCUMENTS

| | | | | |
|---|---|---|---|---|
| 4,735,217 | A * | 4/1988 | Gerth | A24F 47/008 128/203.17 |
| 5,331,979 | A * | 7/1994 | Henley | A24F 47/002 131/273 |
| 5,799,663 | A * | 9/1998 | Gross | A24F 47/002 131/270 |
| 8,205,622 | B2 | 6/2012 | Pan | |

(Continued)

FOREIGN PATENT DOCUMENTS

| | | |
|---|---|---|
| FR | 3 003 442 A1 | 9/2014 |
| WO | WO-2013089551 A1 | 6/2013 |

(Continued)

OTHER PUBLICATIONS

International Search Report and Written Opinion of Application No. PCT/EP2016/077504 dated Feb. 21, 2017.

*Primary Examiner* — Tulsidas C Patel
*Assistant Examiner* — Peter G Leigh
(74) *Attorney, Agent, or Firm* — Harness, Dickey & Pierce, P.L.C.

(57) ABSTRACT

An e-vaping section includes an outer housing, a supply reservoir, an inner tube, and a heater capable of vaporizing a pre-vapor formulation. The section includes a female threaded connector on an end of the e-vaping section that defines an air inlet positioned adjacent to threads of the connector. A power section includes an outer housing and a power supply, with a male treaded connector defining a vent hole. An assembled e-vaping device connects two e-vaping sections via the male and female threaded connectors causing the air inlet and vent hole to be in fluid communication with each other. A method of manufacturing an e-vaping device includes adjusting a cross-sectional area of the air inlets defined by the female threaded connector to adjust a resistance-to-draw (RTD) value for the device.

33 Claims, 5 Drawing Sheets

(56) References Cited

U.S. PATENT DOCUMENTS 8,314,591 B2* 11/2012 Terry ..... A24F 47/008 320/114
8,511,318 B2* 8/2013 Hon ..... A24F 47/002 128/202.21
8,910,641 B2* 12/2014 Hon ..... A24F 47/002 128/202.21
2005/0016550 A1* 1/2005 Katase ..... A24F 47/002 131/194
2006/0054165 A1* 3/2006 Hughes ..... A61M 15/009 128/200.14
2009/0151717 A1* 6/2009 Bowen ..... A61M 11/041 128/200.23
2009/0260642 A1* 10/2009 Monsees ..... A24F 47/006 131/194
2011/0120455 A1* 5/2011 Murphy ..... A24F 47/002 128/200.18
2011/0277760 A1* 11/2011 Terry ..... A24F 47/008 128/203.12
2011/0277764 A1* 11/2011 Terry ..... A24F 47/008 128/203.26
2011/0303231 A1* 12/2011 Li ..... A24F 47/008 131/329
2013/0056013 A1* 3/2013 Terry ..... A24F 47/008 131/328
2013/0061861 A1* 3/2013 Hearn ..... A24F 47/006 131/329
2013/0192615 A1* 8/2013 Tucker ..... H01C 17/00 131/328
2013/0192617 A1 8/2013 Thompson
2013/0192620 A1* 8/2013 Tucker ..... H01C 17/00 131/329
2013/0192621 A1* 8/2013 Li ..... H01C 17/00 131/329
2013/0192623 A1* 8/2013 Tucker ..... H01C 17/00 131/329
2013/0213419 A1* 8/2013 Tucker ..... A24F 47/008 131/328
2013/0228191 A1* 9/2013 Newton ..... A61M 15/06 131/329
2013/0255675 A1 10/2013 Liu
2013/0284194 A1 10/2013 Newton
2013/0306065 A1 11/2013 Thorens et al.
2013/0319438 A1* 12/2013 Liu ..... A24F 47/008 131/329
2013/0340778 A1 12/2013 Liu
2014/0020696 A1 1/2014 Liu
2014/0060554 A1 3/2014 Collett et al.
2014/0076310 A1 3/2014 Newton
2014/0096781 A1 4/2014 Sears et al.
2014/0174458 A1 6/2014 Katz
2014/0190501 A1 7/2014 Liu
2014/0202472 A1* 7/2014 Levitz ..... A24F 13/22 131/187
2014/0216450 A1 8/2014 Liu
2014/0261486 A1 9/2014 Potter et al.
2014/0261489 A1 9/2014 Cadieux et al.
2014/0283823 A1 9/2014 Liu
2014/0290676 A1 10/2014 Liu
2014/0299137 A1 10/2014 Kieckbusch et al.
2014/0305452 A1 10/2014 Liu
2014/0334802 A1 11/2014 Dubief
2015/0027456 A1* 1/2015 Janardhan ..... A24F 47/008 131/328
2015/0027457 A1* 1/2015 Janardhan ..... A24F 47/008 131/328
2015/0027469 A1 1/2015 Tucker et al.
2015/0090256 A1 4/2015 Chung
2015/0114409 A1 4/2015 Brammer et al.
2015/0136158 A1 5/2015 Stevens et al.
2015/0164146 A1 6/2015 Li et al.
2015/0216232 A1* 8/2015 Bless ..... A24F 47/008 131/328
2015/0245658 A1 9/2015 Worm et al.
2015/0245669 A1 9/2015 Cadieux et al.

FOREIGN PATENT DOCUMENTS

WO WO-2015026948 A1 2/2015
WO WO-2015042412 A1 3/2015

* cited by examiner

E-VAPING SECTION AND E-VAPING DEVICE, AND A METHOD OF MANUFACTURING THEREOF

BACKGROUND OF THE INVENTION

Field of the Invention

Example embodiments relate generally to an e-vaping device that may be operable to deliver a pre-vapor formulation from a supply reservoir to a heater. The heater may volatilize the pre-vapor formulation to form a vapor.

Related Art

Electronic vaping ("e-vaping") devices may be used by adult vapers as a portable means of vaping. E-vaping devices may include several elements including a supply reservoir capable of holding a pre-vapor formulation, a heater to vaporize the pre-vapor formulation, a power supply to energize the heater, and a sensor and control circuitry to determine if an adult vaper is operating the e-vaping device in order to cause the power supply to energize the heater.

The e-vaping device may include two distinct sections: a first section that may be a cartridge that may include the supply reservoir and the heater; and a second section that may include the power source (that may be a battery), and the sensor and control circuitry. The first section may be a disposable section, or alternatively the first section may be a non-disposable section. The second section may be non-disposable (such that the power supply may be rechargeable), or alternatively the second section may be a disposable section. Optionally, the e-vaping device may include only one section (where all of the elements of the device may be included in the one section), or the e-vaping device elements may be included in more than two sections (especially if a connector and/or adapter is involved in coupling sections of the device).

Vents may be included in the e-vaping device that permit the draw of air into (and through) the e-vaping device, and entrain the intake air with the vapor that is created by the volatilized pre-vapor formulation. The vents, which may be essentially air-holes, may be located in an end of a section of the device that includes the power supply. These vents may exhibit clogging, due to dust and other environmental conditions. Once clogged, the e-vaping device may exhibit problems associated with an increased Resistance to Draw (RTD). This increased RTD may cause the adult vaper to experience a decreased satisfaction. The increased RTD may also result in premature replacement of the power supply, even when the power supply and associated electronics are still operational and have not reached a complete end of life cycle.

SUMMARY OF THE INVENTION

At least one example embodiment relates to an e-vaping cartridge.

In one embodiment, the e-vaping cartridge includes, an outer housing extending in a longitudinal direction; a supply reservoir configured to contain a pre-vapor formulation within the outer housing; an inner tube extending in the longitudinal direction within the outer housing, the inner tube defining a channel; a heater exposed to a portion of the channel, the heater configured to heat the pre-vapor formulation to form a vapor; and a female threaded connector with first threads on an end of the e-vaping cartridge, the female threaded connector defining at least a portion of at least one air inlet traversing through a side wall of the female threaded connector that is positioned adjacent to the first threads.

In one embodiment, the at least one air inlet is positioned near a distal end of the female threaded connector and the outer housing, the first threads being positioned at a proximal location on the female threaded connector relative to the distal end of the connector.

In one embodiment, the distal end of the female threaded connector is near a distal-most end of the e-vaping cartridge.

In one embodiment, the at least one air inlet is in fluid communication with the channel defined by the inner tube.

In one embodiment, the first threads of the female threaded connector are configured to mate with a male threaded connector on an end of a power section of an e-vaping device.

In one embodiment, the heater is configured to receive an electrical current from the power section in order to heat the pre-vapor formulation to form the vapor.

In one embodiment, the at least one air inlet is configured to be in fluid communication with at least one air inlet on the end of the power section of the e-vaping device if the e-vaping cartridge is connected to the power section of the e-vaping device.

In one embodiment, the at least one air inlet is configured to be in fluid communication with the channel defined by the inner tube if the e-vaping cartridge is connected to the power section of the e-vaping device.

In one embodiment, the outer housing also defines a portion of the at least one air inlet.

At least another example embodiment relates to a power section.

In one embodiment, the power section includes, an outer housing extending in a longitudinal direction; a power supply within the outer housing; a male threaded connector with first threads on an end of the power section, the male threaded connector defining at least one vent hole traversing through a side wall of the male threaded connector.

In one embodiment, the first threads are positioned near a distal end of the male threaded connector, the at least one vent hole being positioned at a proximal location on the male threaded connector relative to the distal end of the male threaded connector.

In one embodiment, the distal end of the male threaded connector is near a distal-most end of the power section.

In one embodiment, the first threads on the male threaded connector are configured to mate with a female threaded connector on an end of a cartridge of an e-vaping device.

In one embodiment, the power section further includes a post near the end of the power section, the post being electrically connected to the power supply, wherein the post defines a central passage running clear-through a longitudinal length of the post, the at least one vent hole being in fluid communication with the central passage defined by the post.

In one embodiment, the power section further includes, a puff sensor in fluid communication with the central passage defined by the post, the puff sensor being configured to detect a pressure drop within the power section; and control circuitry configured to cause the power supply to transmit an electrical current to a heater of the cartridge if the power section is connected to the cartridge and the puff sensor detects the pressure drop within the power section.

In one embodiment, the at least one vent hole is configured to be in fluid communication with at least one air inlet on the end of the cartridge if the power section is connected to the cartridge.

In one embodiment, the at least one vent hole is configured to be in fluid communication with ambient atmosphere, by virtue of the at least one vent hole being in fluid communication with the at least one air inlet on the end of the cartridge, if the power section is connected to the cartridge.

In one embodiment, no additional vent holes exist in the power section that are in fluid communication with ambient atmosphere, if the power section is connected to the cartridge, other than the at least one vent hole defined by the male threaded connector.

At least another example embodiment relates to an e-vaping device.

In one embodiment, the e-vaping device includes, a first section, the first section including, a first outer housing extending in a longitudinal direction, a supply reservoir configured to contain a pre-vapor formulation within the first outer housing, an inner tube extending in the longitudinal direction within the first outer housing, the inner tube defining a channel, a heater exposed to a portion of the channel, the heater being configured to heat the pre-vapor formulation to form a vapor, a female threaded connector with first threads on an end of the first section, the female threaded connector defining at least a portion of at least one air inlet traversing through a side wall of the female threaded connector that is positioned adjacent to the first threads; and a second section, the second section including, a second outer housing, a power supply within the second outer housing, a male threaded connector with second threads on an end of the second section that is mateable with the female threaded connector of the first section, the male threaded connector defining at least one vent hole traversing through a side wall of the male threaded connector, wherein the at least one air inlet and the at least one vent hole are in fluid communication with each other, and in fluid communication with ambient atmosphere and the channel, if the first section is connected to the second section via the male and female threaded connectors.

In one embodiment, no additional air inlets exist in the first and second sections that are in fluid communication with ambient atmosphere, if the first section is connected to the second section, other than the at least one air inlet defined by the female threaded connector.

In one embodiment, a total cross-sectional area of the at least on vent hole is greater than a total cross-sectional area of the at least one air inlet.

In one embodiment, the e-vaping device has a resistance-to-draw (RTD) value of about 70 and 140 mm $H_2O$ if the first section is connected to the second section.

In one embodiment, the e-vaping device has a resistance-to-draw (RTD) value of about 94 and 135 mm $H_2O$ if the first section is connected to the second section.

In one embodiment, the at least one air inlet is positioned near a distal end of the female threaded connector, the first threads being positioned at a proximal location on the female threaded connector relative to the distal end of the female threaded connector, the second threads are positioned near a distal end of the male threaded connector, the at least one vent hole being positioned at a proximal location on the male threaded connector relative to the distal end of the male threaded connector.

In one embodiment, the first outer housing also defines a portion of the at least one air inlet.

At least another example embodiment relates to a method of manufacturing an e-vaping device.

In one embodiment, the method of manufacturing an e-vaping device includes, coupling a first section of the e-vaping device to a second section of the e-vaping device, the first section having a first end and a second end and including, a first outer housing extending in a longitudinal direction, a supply reservoir configured to contain a pre-vapor formulation within the first outer housing, an inner tube extending in the longitudinal direction within the first outer housing, the inner tube defining a channel, a heater exposed to a portion of the channel, the heater being configured to heat the pre-vapor formulation to form a vapor, a female threaded connector with first threads on the first end of the first section, the female threaded connector defining at least one air inlet traversing through a side wall of the female threaded connector that is positioned adjacent to the first threads, the second section including, a second outer housing, a power supply within the second outer housing, a male threaded connector with second threads on an end of the second section that is mateable with the female threaded connector of the first section, the male threaded connector defining at least one vent hole traversing through a side wall of the male threaded connector, wherein the at least one air inlet and the at least one vent hole are in fluid communication with each other, and in fluid communication with ambient atmosphere and the channel, connecting a pressure drop sensing device to the second end of the first section; measuring a resistance-to-draw (RTD) value using the pressure drop sensing device; adjusting an overall cross-sectional area of the air inlets in the first section; and repeating the measuring and the adjusting steps to obtain a desired RTD value.

In one embodiment, no additional air inlets exist in the first and second sections of the e-vaping device that are in fluid communication with ambient atmosphere, other than the at least one air inlet defined by the female threaded connector.

In one embodiment, a total cross-sectional area of the at least on vent hole is greater than a total cross-sectional area of the at least one air inlet.

In one embodiment, the e-vaping device has a desired RTD value of about 70 and 140 mm $H_2O$.

In one embodiment, the e-vaping device has a resistance-to-draw (RTD) value of about 94 and 135 mm $H_2O$.

In one embodiment, the at least one air inlet is positioned near a distal end of the female threaded connector, the first threads being positioned at a proximal location on the female threaded connector relative to the distal end of the female threaded connector, the second threads are positioned near a distal end of the male threaded connector, the at least one vent hole being positioned at a proximal location on the male threaded connector relative to the distal end of the male threaded connector.

In one embodiment, the first outer housing also defines a portion of the at least one air inlet.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1A:
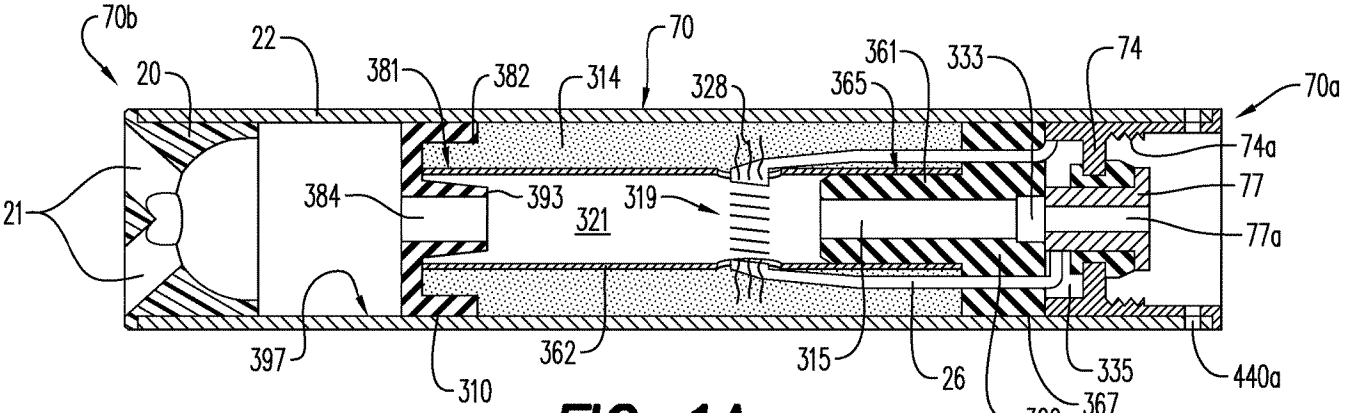
FIG. 1A is an illustration of a cross-sectional view of a first section of an e-vaping device, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, but do not preclude the presence or addition of one or more other features, integers, steps, operations, elements, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1A is an illustration of a cross-sectional view of a first section 70 of an e-vaping device 60 (see an overall e-vaping device 60 in FIG. 3), in accordance with an example embodiment. The first section 70 may be a "cartridge" section of the device 60.

The first section 70 may extend in a longitudinal direction with an inner tube (or chimney) 362 coaxially positioned within an outer housing 22 of the section 70. The first section 70 may include a mouth-end insert 20 at an end 70*b* of the first section 70, with outlets 21 located at ends of off-axis passages angled outwardly in relation to a longitudinal direction of the e-vaping device 60. In an embodiment, there may be only a single centrally located outlet 21.

A nose portion 361 of a gasket (or seal) 320 may be fitted into an end portion 365 of the inner tube 362, where an outer perimeter 367 of the gasket 320 may provide a liquid-tight seal with an interior surface 397 of the outer housing 22. The gasket 320 may also include a central, longitudinal air passage 315, which may open into an interior of the inner tube 362 to define a central channel 321. A transverse channel 333 at a portion of the gasket 320 may intersect and communicate with the central, longitudinal air passage 315 of the gasket 320. This channel 333 assures communication between the central, longitudinal air passage 315 and a space 335 defined between the gasket 320 and the threaded connection 74.

A nose portion 393 of a gasket 310 may be fitted into an end portion 381 of the inner tube 362. An outer perimeter 382 of the gasket 310 provides a substantially liquid-tight seal with an interior surface 397 of the outer housing 22. The gasket 310 may include a central channel 384 disposed between the central passage 321 of the inner tube 362 and the mouth end insert 20.

A reservoir 314 may be contained in an annulus between the inner tube 362 and the outer housing 22, and between the first gasket 320 and the second gasket 310. Thus, the reservoir 314 may at least partially surround the central air passage 321. The reservoir 314 may contain a pre-vapor formulation. The reservoir 314 may also optionally include a storage medium (not shown), such as a fibrous and/or gauze structure, capable of suspending the pre-vapor formulation. The pre-vapor formulation may include one or more vapor formers, water, one or more "flavorants" (a compound providing flavor/aroma), and nicotine. For instance, the pre-vapor formulation may include a tobacco-containing material including volatile tobacco flavor compounds which are released from the pre-vapor formulation upon heating. The pre-vapor formulation may also be a tobacco flavor containing material or a nicotine-containing material. Alternatively, or in addition, the pre-vapor formulation may include a non-tobacco material(s). For example, the pre-vapor formulation may include water, solvents, active ingredients, ethanol, plant extracts and natural or artificial flavors. The pre-vapor formulation may further include a vapor former. Because of the diversity of suitable pre-vapor formulation, it should be understood that these various pre-vapor formulations may include varying physical properties, such as varying densities, viscosities, surface tensions and vapor pressures.

A heater 319 may extend through the central air passage 321 of the inner tube 362, or the heater 319 may otherwise be exposed to the central air passage 321. The heater 319 may be in contact with a filamentary wick 328, which may extend between opposing sections of the reservoir 314, so as to deliver the pre-vapor formulation from the reservoir 314 to the heater 319. The heater 319 may vaporize the pre-vapor formulation in order to produce a vapor that may become entrained in the central air passage 321. Electrical leads 26 may be electrically connected to the heater in order to energize the heater when the device 60 is actively being used by an adult vaper. The electrical leads 26 may also be electrically connected to a post 77 that is configured to provide an electrical contact with post 78 (FIG. 2) when the first section 70 is connected to the second section 72 to form an e-vaping device 60 (see an assembled e-vaping device 60 illustrated in FIG. 3). The post 77 may include a central passage 77*a* running longitudinally through a center portion of the post 77, where the central passage 77*a* may be in fluid communication with the air passage 315. Alternatively, post 77 may be closed at the distal end and instead have side-vents in fluid communication with central passage 77*a* (such that central passage 77*a* does not cut clear-through a longitudinal length of the post 77, but instead only intersects the proximal end of the post 77). One or more air inlets 440 may be positioned near an end of the first section 70.

An end 70*a* of the first section 70 may include a threaded connector 74 that may mate with threads 76*a* (FIG. 2) of the second section 72. In an embodiment, the first section 70 may include a female connector 74 with threads 74*a* positioned on an inner surface of the connector 74 that may mate with the male connector 76 of the second section 72.

Air Vents in the First Section

One or more air vents (vent holes) 440*a* may be positioned near the end 70*a* of the first section 70, where the holes 440*a* may be in fluid communication with an ambient atmosphere (surrounding the first section 70). In an embodiment, the one or more vent holes 440*a* may penetrate both the outer housing 22 and the female threaded connector 74, such that the holes 440*a* may be positioned directly adjacent to the threads 74*a* (at a more distal location of the connector 74, relative to the location of the threads 74*a*, such that the threads 74*a* may be "set inside" of the connector 74). Specifically, the holes 440*a* may penetrate a distal location of the threaded connector 74 and the outer housing 22 of the first section 70, relative to the threads 74*a* that may be positioned at a more proximal location an inner surface of the connector 74 (where this distal end of the connector 74 may be near the distal-most end of the first section 70).

Figure 1B:
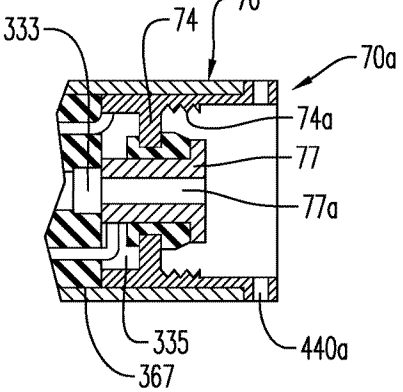
FIG. 1B is an illustration of a cross-sectional view of an alternative embodiment of an end of a first section of an e-vaping device, in accordance with an example embodiment.

In an alternative embodiment (as illustrated in FIG. 1B), the holes 440*a* may penetrate the threaded connector 74 and not the housing 22, as the threaded connector 74 may form a longer portion of an outer surface of the end 70*a* of the first section 70, relative to the embodiment shown in FIG. 1A.

The vent holes 440*a* may have a circular cross-section. Alternatively, the vent holes 440*a* may have a square cross-section, or the cross-section may be another shape. In the event the holes 440*a* have a circular cross-section, a relative diameter of the holes 440*a* may be smaller than a relative diameter of the vent holes 440*b* depicted in FIG. 2 (discussed below), as the holes 440*a* in the first section 70 may be considered a "bottle-neck" of the flow path of air that enters through vent holes 440*a* and filters into vent holes 440*b* (in second section 72), where this flow path is described in more detail below. A purpose of the relative diameter of the holes 440*a* being smaller than the diameter of the holes 440*b* is to ensure that a flow path of air entering the device 60 is restricted by these holes 440*a* of the device 60 (as opposed to being restricted by the holes 440*b* of the second section 72), so that the holes 440*a* of the first section 70 may, in essence, screen/filter potential debris in the environment that may inadvertently enter and potential plug the holes 440*a*. In creating this "bottle neck" effect of the flow path at the first section 70, rather than at the second section 72, in the event that debris does enter and plug holes 440*a* the first section 70 may ultimately be discarded (as the first section 70 may be a disposable section), while the second section 72 may remain in active operational use for a complete life cycle of the second section 72 (especially in the event that the second section 72 is a non-disposable section). In the event the holes 440*a* have a cross-sectional shape that is not circular, a relative cross-sectional area of the holes 440*a* may be smaller than a relative cross-sectional area of the holes 440*b*.

Figure 2:
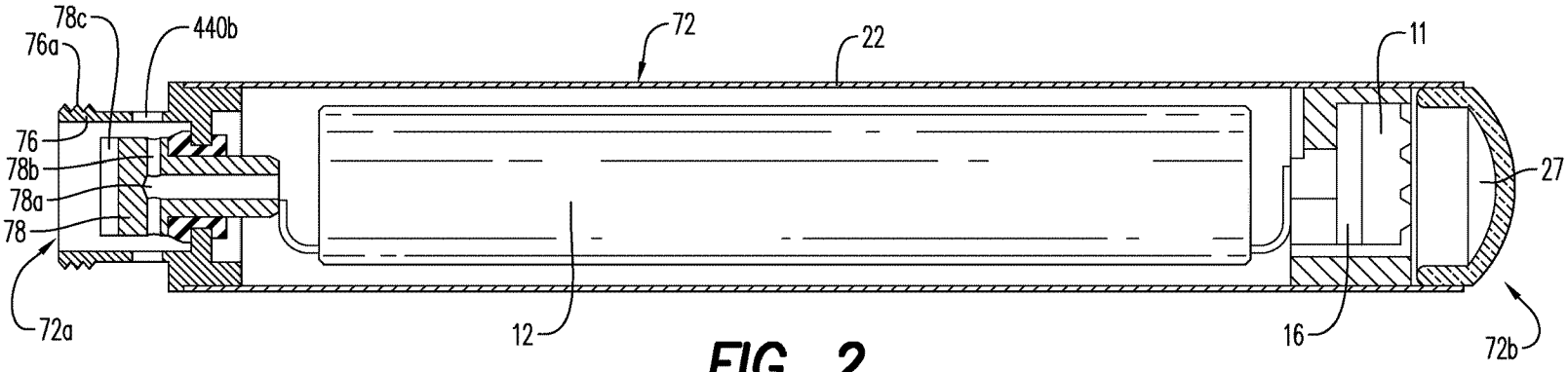
FIG. 2 is an illustration of a cross-sectional view of a second section of an e-vaping device, in accordance with an example embodiment.

FIG. 2 is an illustration of a cross-sectional view of a second section 72 of an e-vaping device 60, in accordance with an example embodiment. The second section 72 may include a power supply 12, which may be a battery that is either disposable or rechargeable. The power supply 12 may be operable to apply a voltage across the heater 319 (of the first section 70, shown in FIG. 1A). Thus, the heater 319 may volatilize the pre-vapor formulation according to a power cycle of either a time period, such as a 2 to 10 second period. The second section 72 may include a puff sensor 16 with control circuitry 11 which may be on a printed circuit board. The control circuitry 11 may also include a heater activation light 27 that may be operable to glow when the heater 319 is activated. The outer housing 22 may be made of metal, and this housing 22 may act as a ground terminal for an electrical circuit that includes the power supply 12, the puff sensor 16, the control circuitry 11, the electrical leads 26 and the heater 319.

A post 78 may be located at an end 72*a* of the second section 72. The post 78 may be electrically connected to the power supply 12, such that the control circuitry 11 may be capable of sending an electrical current from the power supply 12 through the post 78 to the electrical leads 26 and heater 319 (as described below in more detail).

The end 72*a* of the second section 72 may include a threaded connector 76 that may mate with the threads 74*a* (FIG. 1A) of the first section 70. In an embodiment, the end 72*a* of the second section 72 may include a male connector 76 with threads 76*a* that may mate with the threads 74*a* of the female connector 74 of the first section 70.

Air Vents in the Second Section

One or more air vents (vent holes) 440*b* may be positioned near an end 72*a* of the second section 72. In an embodiment, the one or more vent holes 440*b* may penetrate the connector 76, where the holes 440*b* may be adjacent to the male threads 76*a* of the connector 76. The holes 440*b* may fully penetrate the side walls of the connector 76, in order to create an air path that is in fluid communication with side vents 78*b* and a central passage 78*a* of the post 78. The holes 440*b* may be positioned at a proximal location on the threaded connector 76, relative to the male threads 76*a* that may be on a distal end of the connector 76 (where the distal end of the connector 76 may be the distal-most end of the second section 72).

The vent holes 440*b* may have a circular cross-section. Alternatively, the vent holes 440*b* may have a square cross-section, or the cross-section may be another shape. As stated above, a diameter of the vent holes 440*b* may be relatively larger than a diameter of the vent holes 440*a* of the first section 70, in the event that the holes 440*a/b* are circular (otherwise, a cross-sectional area of the vent holes 440*b* may be larger than a cross-sectional area of the vent holes 440*a* of the first section 70, if the holes 440*a/b* are not circular). This relative size of the holes 440*a/b* may ensure the longevity and useful life of the section 72 (as the relatively smaller-sized holes 440*a* may filter debris from entering the larger holes 440*b*, as described above).

Figure 3:
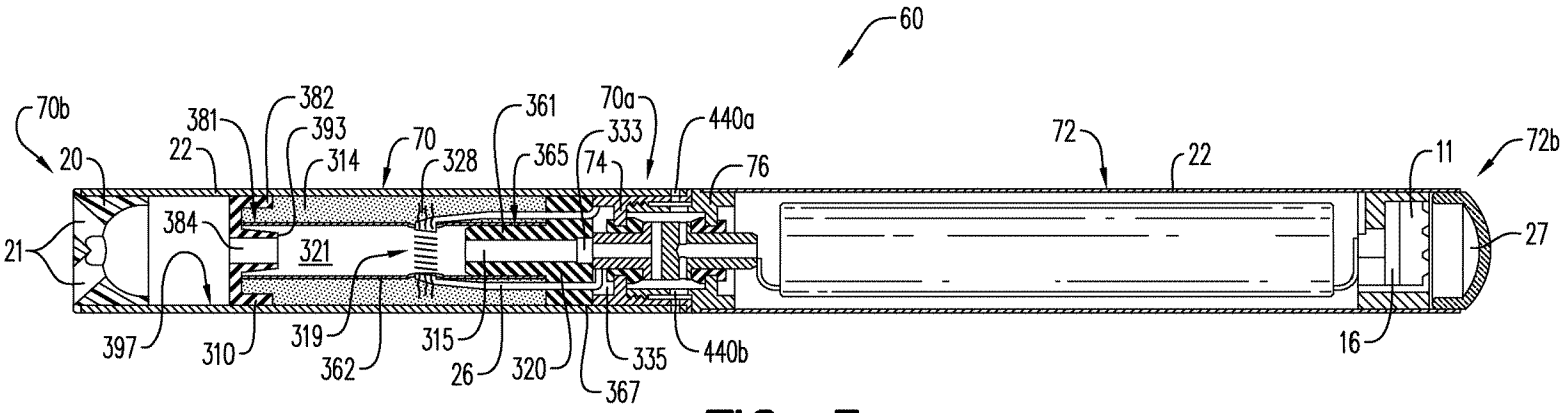
FIG. 3 is an illustration of a cross-sectional view of an assembled e-vaping device, in accordance with an example embodiment.

FIG. 3 is an illustration of a cross-sectional view of an assembled e-vaping device 60, in accordance with an example embodiment. The device 60 may include the two major sections 70/72 (described in detail in relation to FIGS. 1 and 2), where the first section 70 may be a disposable (replaceable) section and the second section 72 may be a reusable fixture. Optionally, both sections 70/72 may also be disposable sections.

The two sections 70/72 may be enclosed by the housing 22 that may run the longitudinal length of the device 60. The outer housing 22 may be formed of any suitable material or combination of materials. The outer housing 22 may be cylindrical and may be formed at least partially of metal and may be part of the electrical circuit (as described in greater detail, herein). Although the housing 22 is described herein as cylindrical, other forms and shapes are also contemplated.

The sections 70/72 may be coupled together by the threaded connectors 74/76. In doing so, the coupled sections 70/72 may cause the vent holes 440*a* of the first section 70 to be in fluid communication with the vent holes 440*b* of the second section 72. This may in turn create a flow path for intake air to be drawn into the e-vaping device 60, as described below in detail.

The E-Vaping Device in Operational Use

Figure 4:
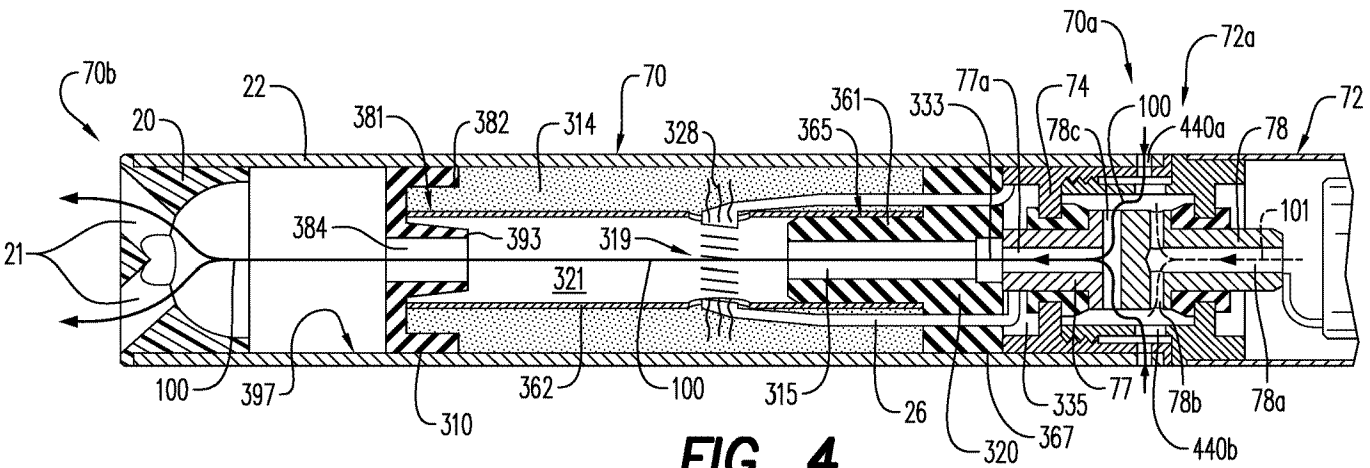
FIG. 4 is an illustration of a cross-sectional view of an assembled e-vaping device depicting a flow path of intake air, in accordance with an example embodiment.

In operational use, air drawn from the air outlets 21 may cause a pressure drop to be created within a central passage of the device 60 (where the central passage may include air passage 315, central channel 321 and channel 384). This pressure drop may, in turn, cause outside ambient air to be drawn into the device 60 via the air inlets 440*a/b* described above. In doing so, the intake air may follow an air flow path that traverses through the one or more air inlets 440*a* of the first section 70, through the one or more air inlets 440*b* of the second section, and the intake air may then traverse along an outer surface of post 78 and flow into channel 78*c* of post 78 (in the second section 72) which may be in fluid communication with a central passage 77*a* of post 77 (in the first section 70), which may be in fluid communication with air passage 315, central channel 321, channel 382 and air outlets 21. This entire flow path 100 of intake air is depicted in FIG. 4, which shows the intake air entering vent holes 440*a* and ultimately discharging through air outlets 21.

Within the second section 72 of the device, the puff sensor 16 may be used to detect a pressure drop within the e-vaping device 60 that is caused by this draw of air. To this end, the central passage 78*a* (running clear-though post 78) may be in fluid communication with the intake air flow 100 that may enter the e-vaping device 60 via vents holes 440*a*/440*b*, via the side vents 78*b*. That is to say, a vacuum pressure force 101 may be formed within the second section 72, caused by the flow of intake air 100, where this vacuum pressure force 101 may exist from the puff sensor 16 through central passage 78*a* of post 78 and side vents 78*b*. In this regard, the puff sensor 16 may therefore be in fluid communication with the air intake pathway 100 that exists between the air vents 440*a* of the first section 70 and the air outlets 21 of the mouth-end insert 20, when the second section 72 is connected to the first section 70. Alternatively, channel 78*c* may be provided on the surface of the post 77 of the first section 70 instead of on the surface of the post 78 of the second section 72.

It is noted that additional air vents (in fluid communication with ambient atmosphere) are not included on the other end 72*b* of the second section 72, nor are air vents (in fluid communication with ambient atmosphere) located at different locations on the second section 72, other than the at least one air vent 440*b* defined by the connector 76 and the post 78, and other than the central passage 78*a* in the post 78 (which is closed off when the second section 72 is connected to the first section 70).

Once the puff sensor 16 senses the reduced pressure drop (i.e., a vacuum force), the control circuitry of the sensor 16 may cause an electrical circuit to close that may include the outer housing 22 (acting as a ground terminal), the battery 12 (acting as a power source), the post 78, the electrical leads 26, and the heater 319, such that the heater 319 may become electrically energized. The energized heater 319 may vaporize the pre-vapor formulation that may be drawn from the reservoir 314 through the wick 328 into the central channel 321. The vapor formed by the energized heater 319 may become entrained in the air flowing through the central channel 321, such that air and entrained vapor then passes through the air outlets 21.

Resistance to Draw (RTD) & Vent Hole Sizes

The placement and sizing of the vent holes 440*a/b* may assist in maintaining a desired resistance to draw (RTD) parameter for an e-vaping device. RTD values may be used to quantify a resistance associated with drawing air through the e-vaping device 60. In an embodiment, by properly placing and sizing the vent holes 440*a/b*, an overall RTD range for the e-vaping device 60 may be between about 40 and 150 mm $H_2O$. In an embodiment, an overall RTD range for the e-vaping device 60 may also be between about 70 and 140 mm $H_2O$. In another embodiment, an overall RTD range for the e-vaping device 60 may be between about 94 and 135 mm $H_2O$.

In an embodiment, the vent holes 440*a* in the first section 70 may be sized to be smaller than the vent holes 440*b* in the second section 72, so that a restricted sizing of the vent holes 440*a* in the first section 70 may create a "bottle neck" effect for intake air entering the e-vaping device 60. The "bottle neck" effect may allow the sizing of the vent holes 440*a* to be an effective controlling parameter in finely adjusting an overall RTD value for the device 60. The "bottle neck" effect provided by the sizing of the vent holes 440*a* in the first section 70 may also allow the vent holes 440*a* to filter/screen debris that may otherwise enter and potentially clog the vent holes 440*b* of the second section 72. To this end, in an embodiment, two vent holes 440*a* may be included in the first section 70 that may be in a range of about 0.59 to 0.61 mm in diameter (in the event the holes 440*a/b* are circular), although other hole diameters may be utilized. Or, in the event that the vent holes 440*a* are either not circular, or the holes 440*a* include only a single hole or more than two holes (i.e., the number of holes 440*a* is something other than two holes), the vent hole(s) 440*a* may have a total cross-sectional surface area of about 0.5468 to 0.5845 $mm^2$. In an embodiment, a number of vent holes 440*a* in the first section 70 may be two vent holes 440*a*, where each hole 440*a* may have a cross-sectional area of between about 0.2734 to 0.2922 $mm^2$. However, the number of holes 440*a* may also be one, or more than two, and therefore a size of these holes 440*a* may in turn vary.

In an embodiment, the vent holes 440*b* on the second section 72 may be about 1.0 mm in diameter (in the event the holes 440*b* are circular), or the holes 440*b* may each have a cross-sectional surface area that is about 0.7854 $mm^2$. This ensures that the holes 440*b* in the second section 72 may be larger than the holes 440*a* in the first section 70. In an embodiment, a number of vent holes 440*b* in the second section 72 may be four vent holes 440*b* (where each hole 440*b* may have a cross-sectional area of about 0.7854 $mm^2$). However, the number of holes 440*b* may also be one, two, or three, or more than four. In an embodiment, the total cross-sectional surface area of the holes 440*b* in the second section 72 may be between three and four times the total cross-sectional surface area of the holes 440*a* in the first section 70.

In an embodiment, a flow path that the intake air may follow (from vent hole 440*a* in the first section to the outlets 21 in the mouth-end insert 20) may be about 45 to 50 mm in total linear distance for a first section 70 having a total length of about 37 mm.

Controlling an Overall RTD Value

Figure 5:
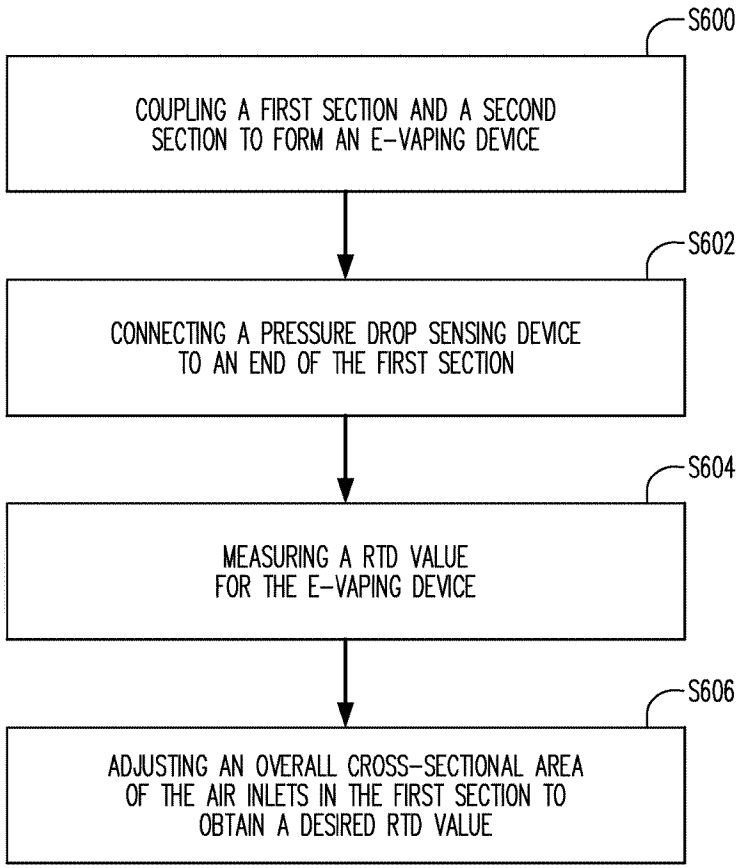
FIG. 5 is a flowchart describing a method of manufacturing an e-vaping device to control a resistance to draw (RTD) value, in accordance with an example embodiment.

FIG. 5 is a flowchart describing a method of manufacturing an e-vaping device 60 to accurately control a resistance to draw (RTD) value, in accordance with an example embodiment. As shown in FIG. 5, in step S600, a first section 70 and a second section 72 may be coupled together (via threaded connectors 74/76) to form an assembled e-vaping device 60.

Figure 6:
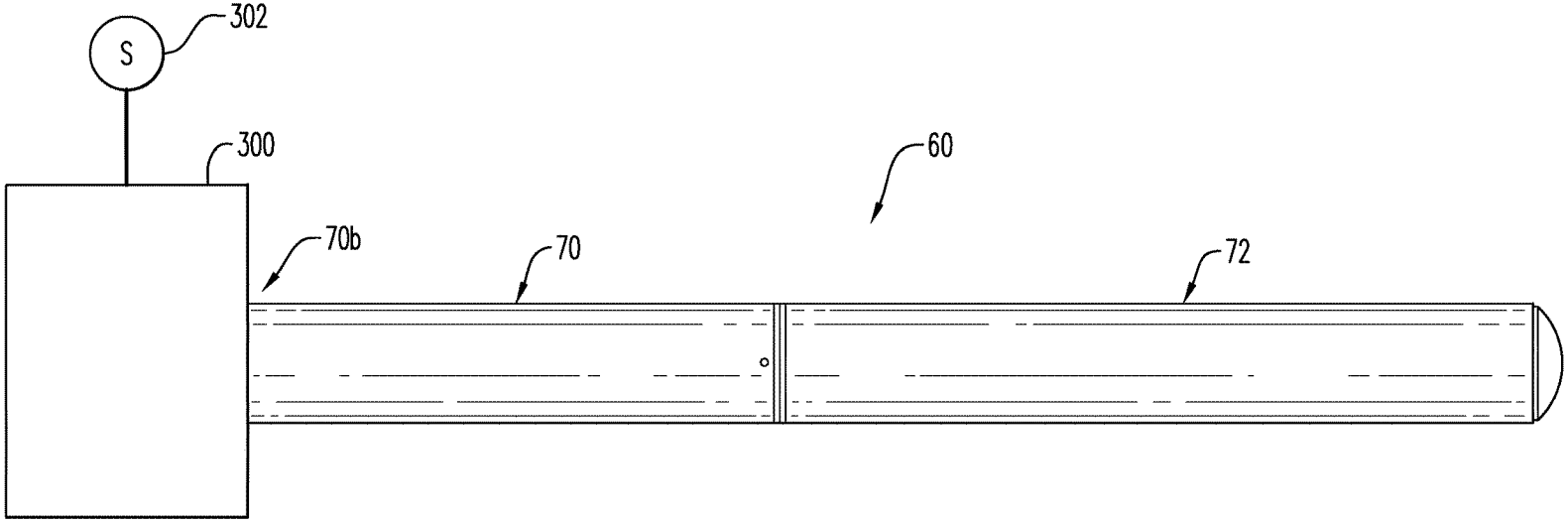
FIG. 6 is an e-vaping device connected to a pressure sensing device capable of measuring a resistance-to-draw (RTD) value for the e-vaping device.

In step S602, a pressure drop sensing device 300 (see FIG. 6) may be connected to an end 70*b* of the first section 70 of the device 60 (where the end 70*b* may include the mouth-end insert 20). The pressure drop sensing device 300 is well-known in the art, as it may be any device 300 (with an associated pressure drop sensor 302), such as a pressure drop tester or other comparable stand-alone instrument, that may effectively measure a pressure drop across an e-vaping device, such as the assembled e-vaping device 60 (shown in FIGS. 3 and 6). Specifically, as is well-known in the art, the pressure drop sensing device 300 may measure a pressure drop by connecting to the end 70*b* of the e-vaping device 60, and forming an air-tight seal with the end 70*b*. The sensing device 300 may then create a known (quantified) vacuum pressure force within the device 300 that may in turn draw air through the device 60. A resulting equilibrium may then be reached, within the sensing device 300 due to the pressure drop across the e-vaping device 60, where the known (quantified) vacuum force within the sensing device 300 may be reduced by the air flow across the e-vaping device 60. The resulting equilibrium vacuum within the sensing device 300 may be measured by the sensor 302, where the resulting equilibrium vacuum in the sensing device 300 equals a measured RTD value.

In step S604, the pressure drop sensing device 300 may be used to measure the RTD value for the e-vaping device 60, where this value constitutes a pressure drop associated with drawing intake air from air vents 440*a* of the first section 70 through air vents 440*b* of the second section 440*b* and through the assembled e-vaping device 60 where the intake air is discharged via the air outlets 21 at an end 70*b* of the first section 70 (indicated as air intake flow path 100, described in association with FIG. 4).

In step S606, an overall cross-sectional area of the vent holes 440*a* in the first section 70 may be adjusted in order to obtain a desired RTD value for the device 60.

In an embodiment, a desired RTD value range for the e-vaping device 60 may be between about 94 and 135 mm $H_2O$. Such a desired range provides a "balanced" flow of air through the e-vaping device 60. Specifically, a "loose" flow of air (caused by vent holes 400*a* being over-sized) may result in a RTD value that is too low, causing a relatively greater amount of air that lacks an adequate amount of entrained vapor within the air. Meanwhile, a "tight" flow of air (caused by vent holes 400*a* being under-sized) may result in a RTD value that is too high, causing a relatively smaller amount of air that does not offer an adequate air flow. By allowing the air inlets 400*a* of the first section 70 to be the "bottle neck" for the intake air (where the vent holes 400*b* of the second section 72 are intentionally over-sized), and by ensuring that no other air intake (i.e., "air inlet") holes exist in the first section 70 or the second section 72 (besides air inlet holes 400*a* that communicate with vent holes 440*b*), the sizing of the air inlet holes 400*a* in the first section 70 may accurately and precisely dictate the RTD value for the overall e-vaping device 60.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. An e-vaping cartridge, comprising:

an outer housing extending in a longitudinal direction;

a supply reservoir configured to contain a pre-vapor formulation within the outer housing;

an inner tube extending in the longitudinal direction within the outer housing, the inner tube defining a channel;

a heater exposed to a portion of the channel, the heater configured to heat the pre-vapor formulation to form a vapor; and a female threaded connector with first threads on an end of the e-vaping cartridge, the female threaded connector defining at least a portion of at least one air inlet traversing through a side wall of the female threaded connector that is positioned adjacent to the first threads, the first threads of the female threaded connector being configured to mate with a male threaded connector on an end of a power section of an e-vaping device, wherein the at least one air inlet is configured to be in direct fluid communication with at least one vent hole on the end of the power section if the e-vaping cartridge is connected to the power section.

2. The e-vaping cartridge of claim 1, wherein the at least one air inlet is positioned near a distal end of the female threaded connector and the outer housing, the first threads being positioned at a proximal location on the female threaded connector relative to the distal end of the connector.

3. The e-vaping cartridge of claim 2, wherein the distal end of the female threaded connector is near a distal-most end of the e-vaping cartridge.

4. The e-vaping cartridge of claim 1, wherein the at least one air inlet is in fluid communication with the channel defined by the inner tube.

5. The e-vaping cartridge of claim 1, wherein the heater is configured to receive an electrical current from the power section in order to heat the pre-vapor formulation to form the vapor.

6. The e-vaping cartridge of claim 1, wherein the at least one vent hole is configured to be in fluid communication with the channel defined by the inner tube if the e-vaping cartridge is connected to the power section of the e-vaping device.

7. The e-vaping cartridge of claim 1, wherein the outer housing also defines a portion of the at least one air inlet.

8. The e-vaping cartridge of claim 1, wherein the female threaded connector fully defines the at least one air inlet.

9. The e-vaping cartridge of claim 8, wherein no additional air inlets exist in the cartridge and the power section that are in direct fluid communication with ambient atmosphere, if the cartridge is connected to the power section, other than the at least one air inlet of the female threaded connector.

10. The e-vaping cartridge of claim 1, wherein the at least one air inlet is defined by a base of a stem of the male threaded connector.

11. A power section, comprising:

an outer housing extending in a longitudinal direction;

a power supply within the outer housing;

a male threaded connector with first threads on an end of the power section, the male threaded connector including a stem and a base, the male threaded connector defining at least one vent hole traversing through a side wall of the stem of the male threaded connector.

12. The power section of claim 11, wherein the first threads are positioned near a distal end of the male threaded connector, the at least one vent hole being positioned at a proximal location on the male threaded connector relative to the distal end of the male threaded connector.

13. The power section of claim 12, wherein the first threads are on a distal-most end of the power section.

14. The power section of claim 11, wherein the first threads on the male threaded connector are configured to mate with a female threaded connector on an end of a cartridge of an e-vaping device.

15. The power section of claim 14, further comprising:

a post near the end of the power section, the post being electrically connected to the power supply, wherein the post defines a central passage running clear-through a longitudinal length of the post, the post further defining at least one side vent in direct communication with the central passage, the at least one vent hole being in direct fluid communication, and at least partially collinearly aligned, with the at least one side vent.

16. The power section of claim 15, further comprising:

a puff sensor in fluid communication with the central passage defined by the post, the puff sensor being configured to detect a pressure drop within the power section; and control circuitry configured to cause the power supply to transmit an electrical current to a heater of the cartridge if the power section is connected to the cartridge and the puff sensor detects the pressure drop within the power section.

17. The power section of claim 14, wherein the at least one vent hole is configured to be in direct fluid communication, and collinearly aligned, with at least one air inlet on the end of the cartridge if the power section is connected to the cartridge.

18. The power section of claim 17, wherein the at least one vent hole is configured to be in fluid communication with ambient atmosphere, by virtue of the at least one vent hole being in direct fluid communication with the at least one air inlet on the end of the cartridge, if the power section is connected to the cartridge.

19. The power section of claim 14, wherein no additional vent holes exist in the power section that are in fluid communication with ambient atmosphere, if the power section is connected to the cartridge, other than the at least one vent hole defined by the male threaded connector.

20. An e-vaping device, comprising:

a first section, the first section including, a first outer housing extending in a longitudinal direction, a supply reservoir configured to contain a pre-vapor formulation within the first outer housing, an inner tube extending in the longitudinal direction within the first outer housing, the inner tube defining a channel, a heater exposed to a portion of the channel, the heater being configured to heat the pre-vapor formulation to form a vapor, a female threaded connector with first threads on an end of the first section, the female threaded connector defining at least a portion of at least one air inlet traversing through a side wall of the female threaded connector that is positioned adjacent to the first threads; and a second section, the second section including, a second outer housing, a power supply within the second outer housing, a male threaded connector with second threads on an end of the second section that is mateable with the female threaded connector of the first section, the male threaded connector defining at least one vent hole traversing through a side wall of the male threaded connector, wherein the at least one air inlet and the at least one vent hole are in direct fluid communication with each other, and in fluid communication with ambient atmosphere and the channel, if the first section is connected to the second section via the male and female threaded connectors.

21. The e-vaping device of claim 20, wherein no additional air inlets exist in the first and second sections that are in fluid communication with ambient atmosphere, if the first section is connected to the second section, other than the at least one air inlet defined by the female threaded connector.

22. The e-vaping device of claim 21, wherein a total cross-sectional area of the at least on vent hole is greater than a total cross-sectional area of the at least one air inlet.

23. The e-vaping device of claim 22, wherein the e-vaping device has a resistance-to-draw (RTD) value of about 70 and 140 mm $H_2O$ if the first section is connected to the second section.

24. The e-vaping device of claim 23, wherein the e-vaping device has a resistance-to-draw (RTD) value of about 94 and 135 mm $H_2O$ if the first section is connected to the second section.

25. The e-vaping device of claim 24, wherein, the at least one air inlet is positioned near a distal end of the female threaded connector, the first threads being positioned at a proximal location on the female threaded connector relative to the distal end of the female threaded connector, the second threads are positioned near a distal end of a stem of the male threaded connector, the at least one vent hole being positioned at a proximal location on the stem of the male threaded connector relative to the distal end of the stem.

26. The e-vaping device of claim 21, wherein the female threaded connector fully defines the at least one air inlet.

27. The e-vaping device of claim 20, wherein the first outer housing also defines a portion of the at least one air inlet.

28. A method of manufacturing an e-vaping device, comprising:

coupling a first section of the e-vaping device to a second section of the e-vaping device, the first section having a first end and a second end and including, a first outer housing extending in a longitudinal direction, a supply reservoir configured to contain a pre-vapor formulation within the first outer housing, an inner tube extending in the longitudinal direction within the first outer housing, the inner tube defining a channel, a heater exposed to a portion of the channel, the heater being configured to heat the pre-vapor formulation to form a vapor, a female threaded connector with first threads on the first end of the first section, the female threaded connector defining at least one air inlet traversing through a side wall of the female threaded connector that is positioned adjacent to the first threads, the second section including, a second outer housing, a power supply within the second outer housing, a male threaded connector with second threads on a first end of the second section that is mateable with the female threaded connector of the first section, the male threaded connector defining at least one vent hole traversing through a side wall of the male threaded connector, wherein the at least one air inlet and the at least one vent hole are in fluid communication with each other, and in fluid communication with ambient atmosphere and the channel, connecting a pressure drop sensing device to a second end of the first section;

measuring a resistance-to-draw (RTD) value using the pressure drop sensing device;

adjusting an overall cross-sectional area of the air inlets in the first section, wherein a total cross-sectional area of the at least one vent hole is greater than a total cross-sectional area of the at least one air inlet; and repeating the measuring and the adjusting steps to obtain a desired RTD value.

29. The method of claim 28, wherein no additional air inlets exist in the first and second sections of the e-vaping device that are in fluid communication with ambient atmosphere, other than the at least one air inlet defined by the female threaded connector.

30. The method of claim 29, wherein the e-vaping device has a desired RTD value of about 70 and 140 mm $H_2O$.

31. The method of claim 30, wherein the e-vaping device has a desired RTD value of about 94 and 135 mm $H_2O$.

32. The method of claim 28, wherein, the at least one air inlet is positioned near a distal end of the female threaded connector, the first threads being positioned at a proximal location on the female threaded connector relative to the distal end of the female threaded connector, the second threads are positioned near a distal end of the male threaded connector, the at least one vent hole being positioned at a proximal location on the male threaded connector relative to the distal end of the male threaded connector.

33. The method of claim 28, wherein the first outer housing also defines a portion of the at least one air inlet.

* * * * *